United States Patent [19]

Okuya

[11] 4,357,592

[45] Nov. 2, 1982

[54] VARIABLE RESISTOR AND SWITCH ASSEMBLY

[75] Inventor: Tsutae Okuya, Miyagi, Japan

[73] Assignee: Alps Electric Company, Ltd., Tokyo, Japan

[21] Appl. No.: 270,006

[22] Filed: Jun. 3, 1981

[30] Foreign Application Priority Data

Jun. 6, 1980 [JP] Japan ..... 55-76091

[51] Int. Cl.[3] ..... H01C 10/50

[52] U.S. Cl. ..... 338/198; 338/179; 338/200; 338/176; 338/183

[58] Field of Search ..... 338/198, 200, 173, 172, 338/191, 194, 179, 171, 202, 183, 188, 176

[56] References Cited

U.S. PATENT DOCUMENTS 3,622,934 11/1971 Yano et al. ..... 338/198

3,633,146 1/1972 Sasaki et al. ..... 338/200 X

*Primary Examiner*—C. L. Albritton

*Attorney, Agent, or Firm*—Guy W. Shoup; Gerard F. Dunne

[57] ABSTRACT

A variable resistor and switch assembly in which a variable resistor and a switch are constructed as a unit. The assembly has an insulating substrate, a resistor, a collector and stationary contacts which are formed on the substrate, and a carrier made of an electrically insulating material. The carrier includes a slider for making sliding contact with the resistor and the collector, a pair of contactors made of a resilient metallic material and making sliding contact with respective one of the pair of stationary contacts, and an operation member made of an electrically insulating material and adapted for breaking the conduction between the pair of contactors. As the operation member is actuated at any desired position of the slider, the conduction between the pair of contactors is broken to make the switch take the off state irrespective of the resistance value of the variable resistor.

4 Claims, 7 Drawing Figures

VARIABLE RESISTOR AND SWITCH ASSEMBLY

BACKGROUND OF THE INVENTION

The present invention relates to a variable resistor and switch assembly and, more specifically, to a variable resistor and switch assembly in which a slider for a variable resistor and two contactors for a switch are provided on a common carrier, so that the resistance value can be varied by a movement of a manipulation lever connected to the carrier and, by actuating an operation member mounted on the carrier at any resistance position, the two contactors can be brought into or out of contact with each other.

SUMMARY OF THE INVENTION

An object of the invention is to provide a variable resistor and switch assembly in which a slider type variable resistor and a switch are assembled as a unit in quite a simple construction.

Another object of the invention is to provide a variable resistor of the type mentioned above, in which the switching operation can be made irrespective of the position of the slider of the variable resistor.

To these ends, according to the invention, there is provided a variable resistor and switch assembly comprising: an insulating substrate; and elongated resistance element, a collector and a stationary contact which are formed on the insulating substrate; and a carrier shaped from an electrically insulating material and provided with a slider for making a sliding contact with the resistance element and the elongated collector, a pair of contactors made of resilient metallic material and adapted to make sliding contact with respective one of the pair of stationary contacts, and an operation member made of an insulating material and adapted for breaking the conduction of the pair of contactors, whereby the conduction of the pair of conductors is broken as the operation member is actuated.

These and other objects, as well as advantageous features of the invention will become clear from the following description of the preferred embodiments taken in conjunction with the accompanying drawings.

DESCRIPTION OF THE PREFERRED EMBODIMENTS

A preferred embodiment of the invention will be described hereinunder with reference to the accompanying drawings.

Figure 1A:
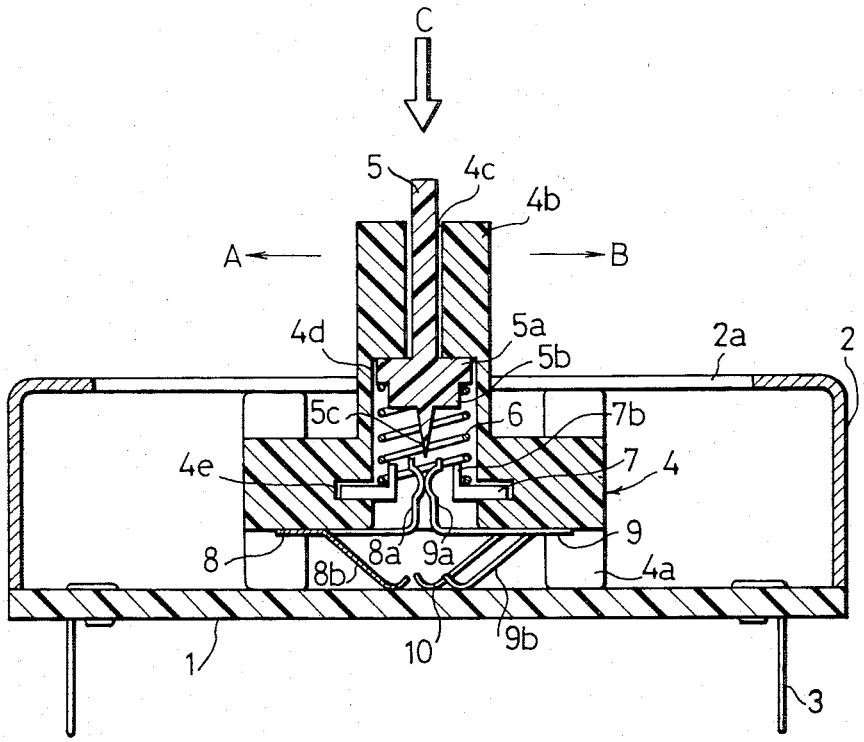
FIGS. 1A and 1B are a sectional side elevational view and a sectional plan view of an essential part of a variable resistor and switch assembly constructed in accordance with an embodiment of the invention.
Figure 1B:
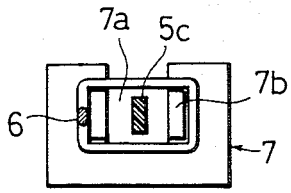
Figure 2:
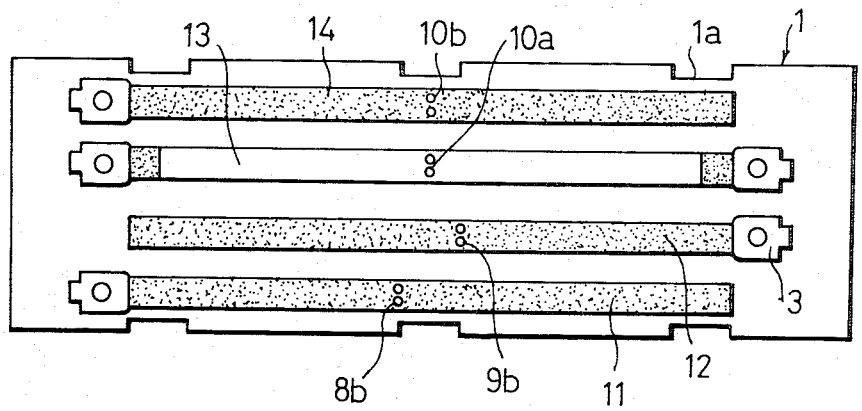
FIG. 2 is a plan view of an insulated substrate.
Figure 3:
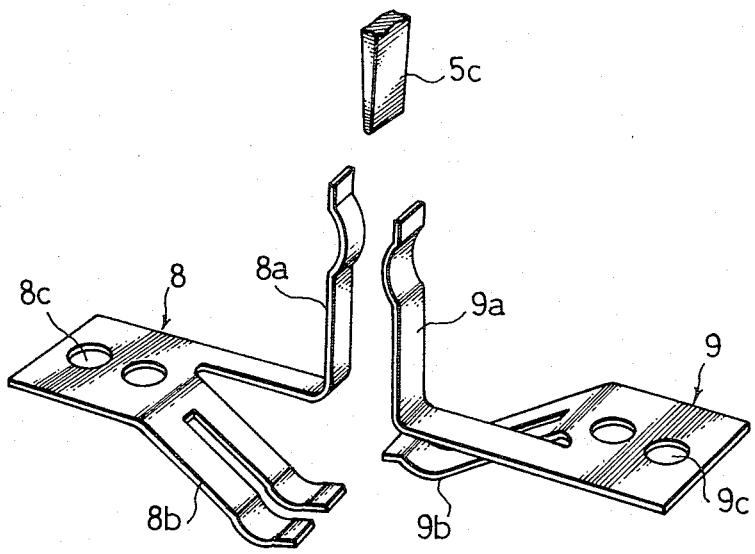
FIG. 3 is a perspective view of a contactor having a contact piece and a movable contact piece.

FIGS. 1A and 1B are a sectional side elevational view and a sectional plan view of an essential part of a variable resistor and switch assembly in accordance with the invention. FIG. 2 is a plan view of an insulating substrate, while FIG. 3 is a perspective view of a contactor.

Referring to these Figures, a reference numeral 1 denotes an elongated insulating substrate fixed to an elongated housing 2. A pair of elongated stationary contacts 11, 12 and an elongated collector 14 are formed by a printing and baking of silver paste or the like material on the substrate. Also, an elongated resistance element 13 of carbon resistance material or the like is formed by printing and baking in a side-by-side relation to the stationary contacts 11, 12 and the collector 14. A reference numeral 2 denotes a substantially box-shaped housing mentioned before. The housing 2 has a guiding slot **2*a* formed in the top surface thereof and extending in the longitudinal direction so as to guide an operation lever 4*b* formed as a unit with the carrier 4. Reference numeral 3 designates terminals connected to the stationary contacts 11, 12, the resistance element 13 and the collector 14, respectively. These terminals are fixed to the aforementioned insulating substrate 1**.

The aforementioned carrier 4 is made, for example, by molding an electrically insulating material, and is provided at its corners with vertical guide legs **4*a*. The carrier 4 is provided on its upper surface with an integral operation lever 4*b*. At the same time, a pair of contactors 8, 9 having contact pieces 8*b*, 9*b* are fixed to the lower side of the carrier 4. The contact pieces 8*b* and 9*b* are adapted to make sliding contact with a pair of stationary contacts 11, 12 formed on the insulating substrate 1. In addition, as shown in FIG. 3, the contactors 8, 9 are provided with upwardly bent movable contacts 8*a*, 9*a*. Numerals 8C and 9C denote holes for fixing contactors 8, 9 to the carrier 4** by caulking.

A slider 10 is caulked also to the lower side of the carrier 4, and is provided with slide contact pieces **10*a*, 10*b* adapted for making sliding cantact with the resistance element 13 and the collector 14 formed on the insulating substrate 1**.

Holes **4*c*, 4*d* are formed in the carrier 4 so as to extend from the upper end of the operation lever 4*b* to the lower surface of the slider support. The upper hole 4*d* has a diameter smaller than that of the lower hole 4*c*. An operation member 5 having a flange 5*a*, a holding section 5*b* for a reset spring 6 and a projection 5*c* having an wedge-shaped end is received by the holes 4*c*, 4*d* with a medium of the reset spring 6. The spring 6 is a coiled spring which is generally rectangular in plan. After inserting the spring 6 into the holding portion 5*b* of the operation member 5 through the lower hole 4*d* of the carrier 4, a retainer 7 having a central notch 7*a* as shown in FIG. 1B is fit in an angular recess 4*e* formed in the side surface of the hole 4*d*, so that the reset spring 6 is clamped between the flange 5*a* of the operation member 5 and the upper surface of the retainer plate 7. In this state, the reset spring 6 acts to normally urge the operation member 5 upwardly. However, since the upward movement of the operation member is stopped by the contact of the flange 5*a* with the step between the holes 4*c* and 4*d*, the end of the operation member 5 projects outwardly only slightly. Also, as shown in FIG. 1, the movable contact pieces 8*a*, 9*a* of the contactors 8, 9** are in contact with each other.

The variable resistor and switch assembly of this embodiment, having the construction described heretofore, operates in a manner explained hereinbelow.

As the operation lever **4*b* is moved in the directions of arrows A and B in FIG. 1, the slide contact pieces 10*a*, 10*b* of the slider 10** slide on the resistance element 13 and the collector 14 to vary the resistance value, as in the case of ordinary slider type vairable resistor.

In addition to this resistance varying function, the variable resistor and switch assembly of the invention has another function of operation of the incorporated switch at any desired value of the resistance.

Figure 4:
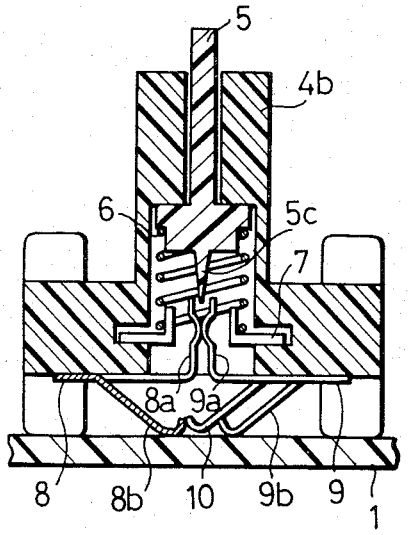
FIGS. 4A and 4B are sectional side elevational views of essential parts.
Figure 4:
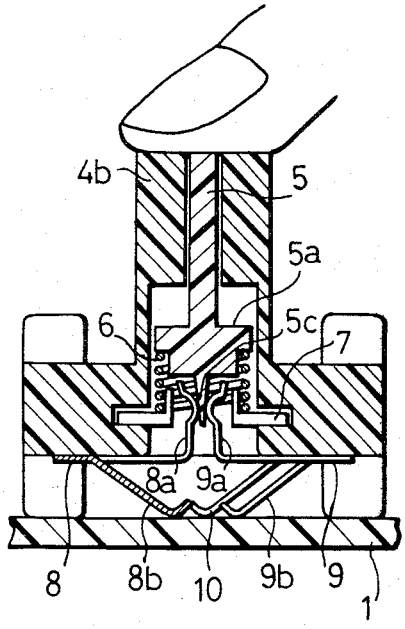

More specifically, referring to FIGS. 4A and 4B showing an essential part in sectional side elevation, the switch takes the ON state with its movable contact pieces 8*a*, 9*a* of the contactors 8, 9 contacting each other when the end of the operation member 5 is projected outwardly from the top surface of the lever 4*b* as shown in FIG. 4A. As the end of the operation member 5 is depressed by a finger or the like as shown in FIG. 4B, the operation member 5 is moved downwardly overcoming the force of the spring 6 so that wedge-shaped projection 5*c* comes between the movable contact pieces 8*a*, 9*a* of the contactors 8, 9. Consequently, the movable contact pieces 8*a* and 9*a* are forcibly spread outwardly so that the switch takes the OFF state.

For turning the switch ON again, the depressing force on the operation member 5 is relieved so that the latter is pushed upwardly by the force of the spring 6 until the flange 5*a* of the operation member 5 comes into contact with the step between the holes 4*c* and 4*d*. In consequence, the movable contact pieces 8*a*, 9*a* are made to contact with each other due to their resiliency, so that the switch takes the ON state.

The movable contact pieces 8*a*, 9*a* which are spread outwardly during turning ON and OFF of the switch are prevented from contacting with the spring 6, by the cooperation between a projection 7*b* formed on the retainer plate 7 and the holding portion 5*b*.

Figure 5:
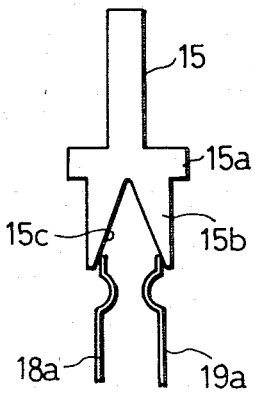
FIG. 5 is a sectional side elevational view of an essential part of another embodiment of the invention.

In the described embodiment, the switch is turned OFF and ON by a depression and release of the operation member 5. To the contrary, if it is required to turn the switch ON by the depression of the operation member 5, the movable contact pieces 18*a*, 19*a* of a pair of contactors are arranged to oppose to each other with a predetermined gap therebetween as shown in FIG. 5, and the operation member 15 provided with a projection 15*b* having a V-shaped notch 15*c* formed in the lower face of the flange 15*a* is disposed in such a manner that the ends of the movable contact pieces 18*a*, 19*a* are engaged by the walls of the V-shaped notch 15*c*. As the operation member 15 is depressed from this state, the movable contact pieces 18*a*, 19*a* are urged inwardly by the walls of the notch 15*c* and come into contact with each other.

Thus, the variable resistor and switch assembly of the invention can be embodied either in push-to-on or in push-to-off type switch.

As has been described, according to the invention, it is possible to obtain a variable resistor and switch assembly in which a variable resistor and a switch are assembled as a unit in quite a simple construction. In addition, the operation of the switch can be made at any resistance value, i.e. irrespective of the position of the slider of the variable resistor. If necessary, it is possible to incorporate a known locking mechanism.

Other changes and modifications are possible without departing from the scope of the invention which is limited solely by the appended claims.

What is claimed is:

1. A variable resistor and switch assembly comprising:

an elongated housing, an insulating substrate secured to said housing, an elongated resistance element deposited in an elongated strip longitudinally along said substrate, a collector of conductive material deposited parallel to said resistance element, a pair of stationary contacts deposited parallel to said resistance element and said collector, a carrier of an electrically insulating material slidably movable within said housing and carrying a slider adapted to slidingly contact said resistance element and said collector, a pair of contactors made of resilient conductive material and slidingly contacting with said stationary contact, said contactors having portions adapted to engage one another, and an operation member made of an electrically insulating material and adapted to change the engagement between the pair of contactors.

2. A variable resistor and switch assembly according to claim 1, wherein the change in engagement between the pair of contactors is made by separating said portions from each other.

3. A variable resistor and switch assembly according to claim 1, the change in engagement between the pair of contactors is made by bringing said portions into contact with one another.

4. A variable resistor and switch assembly comprising:

an elongated housing, an insulating substrate secured to said housing, an elongated resistance element deposited in an elongated strip longitudinally along said substrate, a collector of conductive material deposited parallel to said resistance element, a pair of stationary contacts deposited parallel to said resistance element and said collector, a carrier of an electrically insulating material slidably movable within said housing and carrying a slider adapted to slidingly contact said resistance element and said collector, a pair of contactors made of a resilient metallic material and having respective movable contact pieces formed unitarily therewith and acting as a switch mechanism, and an operation member made of an electrically insulating material and adapted to actuate said pair of contactors, whereby said movable contact pieces formed on said pair of contactors are moved apart from each other as said carrier is actuated.

* * * * *